US005894893A

United States Patent [19]

Nelson

[11] Patent Number: 5,894,893

[45] Date of Patent: Apr. 20, 1999

[54] MACHINE FOR EXTINGUISHING GROUND FIRES

[76] Inventor: Leon E. Nelson, 3221 Raintree Rd., Oklahoma City, Okla. 73120

[21] Appl. No.: 08/769,475

[22] Filed: Dec. 20, 1996

Related U.S. Application Data

[60] Provisional application No. 60/009,987, Dec. 27, 1995.

[51] Int. Cl.[6] ..... A62C 27/00

[52] U.S. Cl. ..... 169/52

[58] Field of Search ..... 169/46, 50, 52, 169/91

[56] References Cited

U.S. PATENT DOCUMENTS

| | | | |
|---|---|---|---|
| 337,086 | 3/1886 | Rumsey | 169/50 |
| 542,754 | 7/1895 | Dawson | 169/50 |
| 2,561,701 | 7/1951 | Hurlbert | 169/52 |
| 4,852,656 | 8/1989 | Banahan | 169/91 |

*Primary Examiner*—Andrew C. Pike

*Attorney, Agent, or Firm*—McKinney & Stringer, P.C.

[57] ABSTRACT

A machine for extinguishing ground fires comprises an extinguisher assembly having a plurality of beating members which forcefully impact the ground as the machine travels over the terrain. The beating members are attached to a core which rotates as the machine advances, thereby imparting a rotating motion to the fibers. The beating members repetitively impact the ground, which motion extinguishes the fire. The machine may be walked or ridden.

35 Claims, 6 Drawing Sheets

MACHINE FOR EXTINGUISHING GROUND FIRES

CROSS REFERENCE TO RELATED APPLICATIONS

This application claims the benefit of U.S. Provisional Application No. 60/009,987, filed on Dec. 27, 1995.

FIELD OF THE INVENTION

The present invention relates to fire extinguishers and, in particular, to mechanical fire extinguishers for extinguishing ground fires.

BACKGROUND OF THE INVENTION

Ground fires can be a help or a hindrance, but in either circumstance, control of the fire is required. Ground fires are sometimes intentionally set to control the growth and type of vegetation and to prepare crop and pasture lands for planting or spring growth. It is important to maintain control of the fire while conducting these activities.

Ground fires often are started through carelessness and must be extinguished. All too frequently, travelers carelessly start fires near busy highways or rural fields of grass, brush or other dry vegetation. Ground fires, whether accidentally or intentionally set, spread quickly and require immediate control.

While water and manual labor can be effective fire-fighting tools, such means can be expensive and labor intensive. Excessive quantities of water may be consumed in fighting some large ground fires, resulting in high water consumption and increased costs. Manual means are labor intensive and inefficient.

SUMMARY OF THE INVENTION

The present invention is directed to a machine for extinguishing ground fires. The machine is adapted to travel over ground and comprises an extinguisher assembly adapted to repetitively and forcefully contact the ground as the machine travels over the ground in the area of the fire. The repetitive, forceful contact of the extinguisher assembly with the ground causes the fire to be extinguished.

The present invention is further directed to a machine for extinguishing ground fires. The machine comprises a movable frame adapted to travel over ground, a frame drive assembly adapted to drive the movement of the frame, a steering assembly adapted to steer the frame as it travels over ground and an extinguisher assembly adapted to repetitively and forcefully contact the ground in the area of the fire as the machine travels over the ground. The repetitive, forceful contact of the extinguisher assembly with the ground causes the fire to be extinguished.

Still further, the present invention is directed to a method for extinguishing ground fires. The method utilizes a machine having contact members. The machine is capable of causing the contact members to repetitively and forcefully contact the ground as the machine is moved over the ground. The fire is extinguished by moving the machine over the ground in the area of the fire.

The present invention comprises a mechanical fire extinguisher which allows the operator of the machine to extinguish ground fires simply by walking behind or riding and steering the machine. The machine of the present invention reduces, and eliminates in some circumstances, the need for water to fight ground fires. Inefficient manual labor is replaced with mechanical means to more effectively and easily extinguish carelessly set ground fires. The machine of the present invention permits better control of intentionally set ground fires.

In accordance with the present invention, there is provided a machine for extinguishing ground fires. The machine comprises a movable frame adapted to travel over burning ground in a direction determined by the operator. The machine further comprises an extinguisher assembly adapted to repetitively and forcefully contact the ground as the machine travels, resulting in extinguishment of the fire. The extinguisher assembly is made of a plurality of fire-resistant contact members, or fibrous bristles, which are attached to a rotating core. The rotational movement of the core imparts movement to the contact members. The core is movably attached to the frame of the machine to permit the contact members to repetitively and forcefully contact the burning ground as the machine travels over the terrain. These and other advantages will be apparent from the following description of the preferred embodiments.

DETAILED DESCRIPTION OF THE PREFERRED EMBODIMENTS

Figure 1:
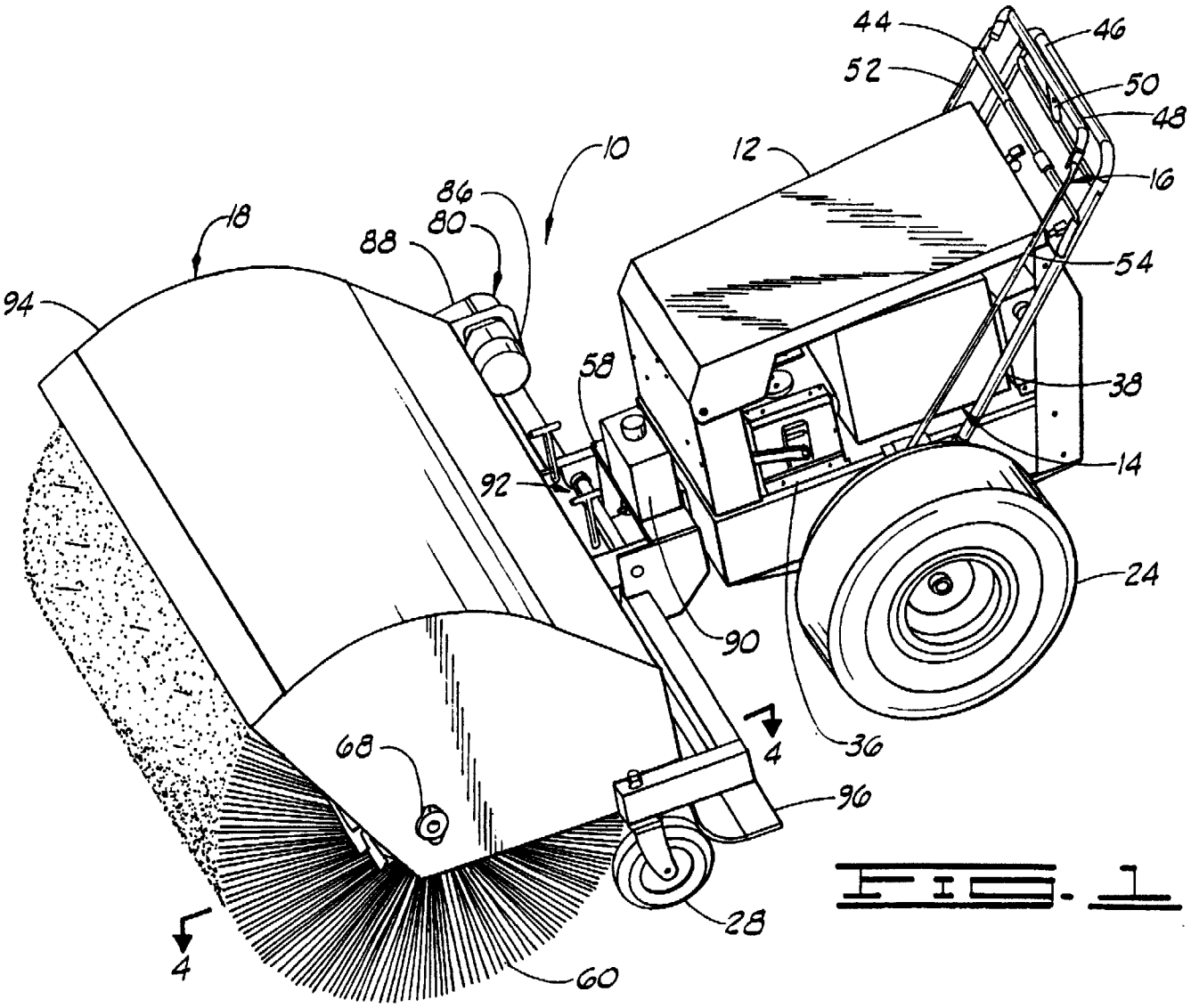
FIG. 1 is a perspective view of a "walk behind" fire extinguishing machine constructed in accordance with the present invention.
Figure 2:
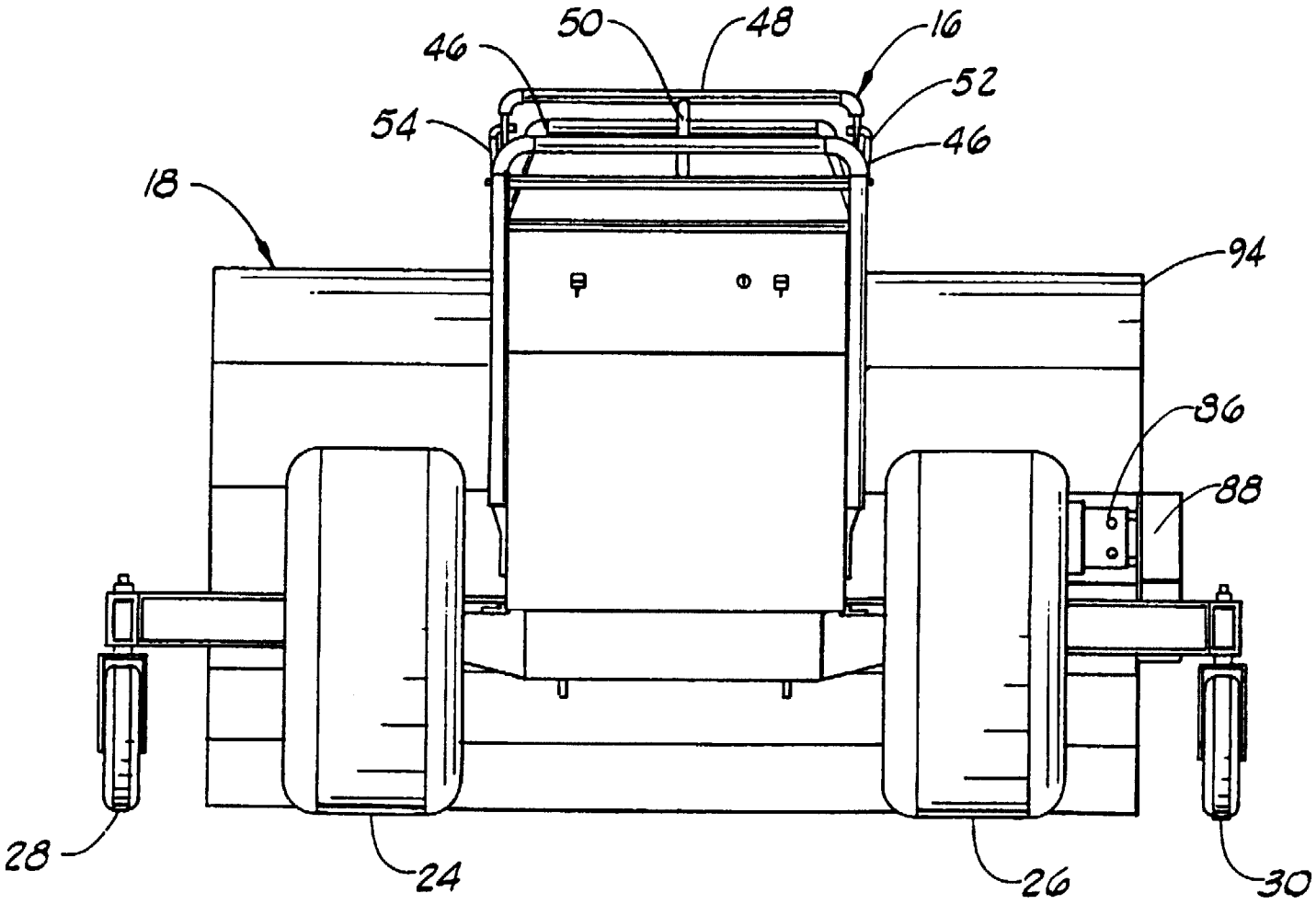
FIG. 2 is a rear view of the fire extinguishing machine of FIG. 1.

With reference now to the drawings in general and to FIGS. 1 and 2 in particular, there is shown therein a ground fire extinguishing machine constructed in accordance with the present invention and designated generally by the reference numeral 10. A preferred embodiment of the machine 10 comprises a frame 12, a frame drive assembly 14 adapted to drive the movement of the frame, a steering assembly 16 adapted to steer the machine in the direction desired by the operator, and an extinguisher assembly 18 adapted to extinguish ground fires.

The frame 12 of the machine 10 is moveable over fiery terrain. The frame may be constructed from of a variety of materials which make the machine lightweight yet strong. A steel metal alloy is preferred to give the machine the desired properties of maneuverability, via the lightweight construction, and durability. A ductile metal material is amenable to the machining process when fashioning the frame 12.

The frame 12 may be constructed in a variety of shapes and sizes, the selection of which is dependent upon external concerns, such as the size of the fire to be controlled or extinguished and the type of vegetation fueling the fire. Regardless of the frame 12 style or size, the frame preferably is partially open to expose the frame drive assembly 14 for a purpose yet to be described. FIG. 1 illustrates a machine which the operator steers while walking behind the machine, much like an upright lawnmower.

With continuing reference to FIG. 2, the frame 12 comprises wheels 24, 26, 28, and 30 to transport the machine 10 over land. The wheels 24, 26, 28, and 30 are positioned to maximize load bearing capability. Wheels 24 and 26 support the frame 12 of the machine 10. In a preferred embodiment, the wheels 24 and 26 are pneumatic tires, similar to those used in operation with All Terrain Vehicles ("ATV"). ATV wheels give the machine 10 a greater ability to travel over rough terrain and, thus, increase the maneuverability and capabilities of the machine.

Wheels, or casters, 28 and 30 support the extinguisher assembly 18 Although, in most instances, the residual heat will be minimal, on occasion, the wheels 28 and 30, being positioned adjacent extinguisher assembly 18, will be exposed to direct flame for short periods of time. In this event, a heat-resistant material is preferred to enable the wheels 28 and 30 to withstand extreme temperatures. The wheels 28 and 30 preferably are comprised of a heat resistant plastic, such as a nylon- or polyurethane-based composition. These materials withstand residual heat in the ground after extinguishment of the fire and provide a suitable wheel material.

Returning to FIG. 1, a frame drive assembly 14 is useful, though not required, to drive the movement of the frame 12 over the terrain. Conventional drive systems, such as those used in powered mowing machines and tractors, are sufficient for this purpose. In one preferred embodiment, the frame drive assembly 14 comprises a hydraulic drive pump 36 and a gasoline engine 38. The gasoline engine 38 powers the drive pump 36 and imparts motion to the wheels 24 and 26 of the frame 12. It will now be appreciated that the frame 12 is partially open to prevent entrapment of vapors which may escape from the fuel tank of the gasoline engine 38. Alternative drive means may be substituted for the frame drive assembly 14 of the fire extinguishing machine 10.

It will be appreciated that the machine 10 is adaptable for use without the aid of a frame drive assembly 14. However, for upright models, it is desirable to construct the machine 10 as a self-powered unit to enable the operator to walk behind and guide the machine as it is propelled over the ground.

Figure 3:
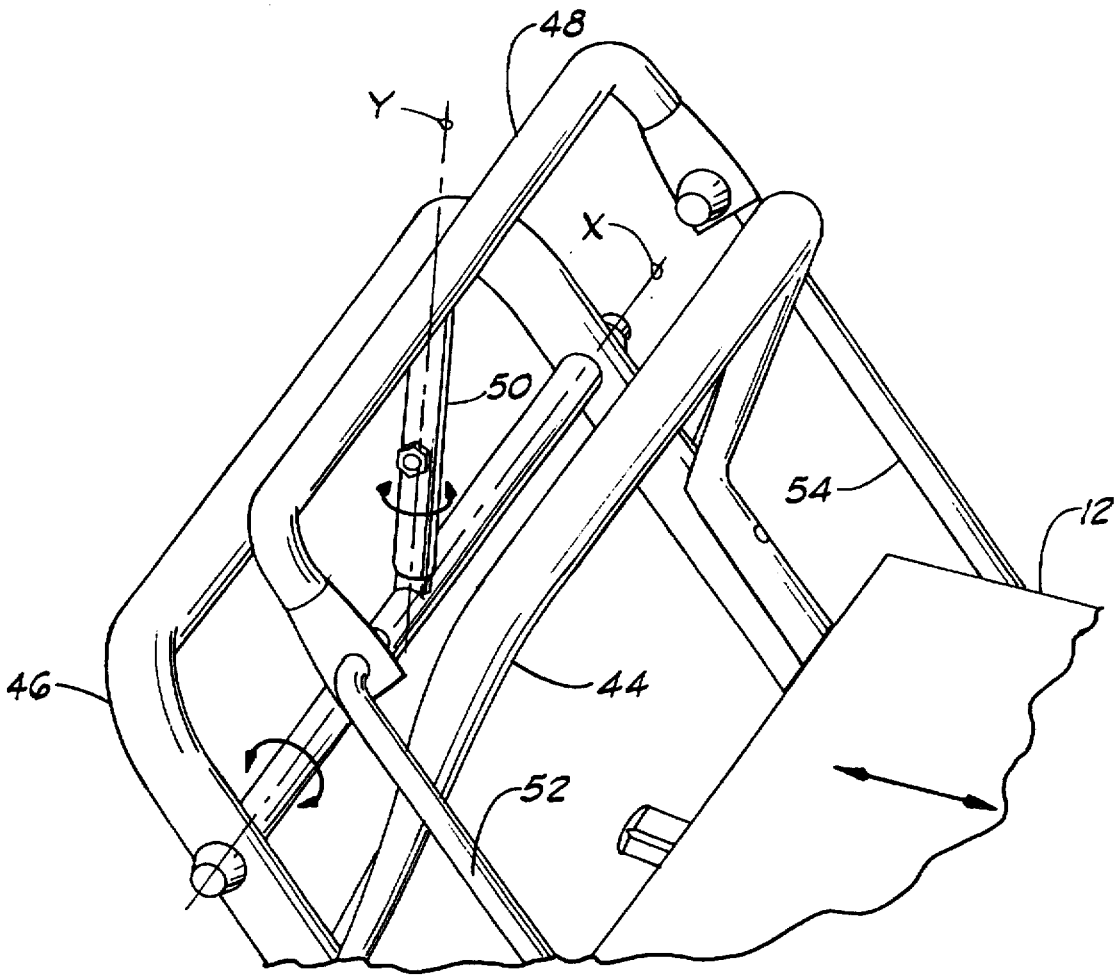
FIG. 3 is a close up view of the steering assembly of the fire extinguishing machine of FIG. 1.

Turning now to FIGS. 1, 2, and 3, the steering assembly 16 controls the direction of movement of the machine 10. Several embodiments of steering assemblies 16 are available for use in conjunction with the particular frame drive assembly 14 employed. One preferred steering assembly 16 comprises handles 44 and 46, a steering bar 48, a handle linkage 50 and steering linkages 52 and 54. The handle linkage 50 is connected to the steering bar 48 and to handle 46, as shown in FIGS. 1 and 2.

The steering linkages 52 and 54 are connected to the hydraulic drive pump 36 of the frame drive assembly 14. Movement of the linkages 52 and 54 forward or backward activates the drive pump 36 for movement of the wheels 24 and 26 of the machine 10. Moving linkage 52 permits the machine to turn left, while moving linkage 54 permits the machine to turn right. Thus, the direction of the machine 10 is controlled by controlling the flow of hydraulics to the wheels 24 and 26 of the machine 10.

The steering bar 48 is pivotable about two axes, x and y, shown in FIG. 3. The direction of the machine 10 is controlled by pivoting the steering bar 48 about the requisite axis. Pivoting the steering bar 48 about the x axis causes forward and backward movement of the machine 10. That is, pushing the steering bar 48 forward toward handle 44 activates the flow of fluids from the hydraulic pump to the wheels 24 and 26 and causes the concomitant forward movement of the machine 10. Pivoting the steering bar 48 about the x axis backward toward handle 46 causes backward movement of the machine 10.

Movement of the steering bar 48 about the y axis enables the operator to turn the machine 10 left or right. The steering linkages 52 and 54 control the flow of fluid to the wheels 24 and 26. When the flow of fluid to one of the wheels 24 or 26 stops, as effectuated by the pivoting the steering bar 48 about they axis, one of the wheels 24 or 26 stops turning. To change directions, the operator turns the machine 10 on the wheel 24 or 26 which is not rotating. Specifically, pivoting the steering bar 48 counterclockwise about the y axis causes the machine 10 to turn left, while pivoting the steering bar clockwise about the y axis causes the machine to turn right.

The steering bar 48 returns to the neutral position when released so that the machine 10 will not operate unless the steering bar is placed in position by the operator. It will be appreciated that alternative conventional steering assemblies enabling the operator to properly guide the machine in the desired direction will suffice.

With continuing reference to FIG. 1, the extinguishing member 18 is connectable to the frame 12 of the machine 10 via a mounting assembly 58. In a preferred embodiment, the mounting assembly 58 comprises a shaft (not shown) on the frame 12 which is receivable in an aperture (not shown) in the extinguisher assembly 18. A pin receivable through the shaft secures the extinguisher assembly 18 to the frame 12 of the machine 10. The mounting assembly 58 permits removal of the extinguisher assembly 18 for maintenance and repair and allows removal of a worn or damaged extinguisher assembly 18 without incurring the cost of a new machine 10.

The extinguisher assembly 18 comprises a plurality of fire-resistant contact members 60. As the machine 10 travels over the terrain, the plurality of contact members 60 forcefully and repetitively contact the ground in the area of the fire. That is, the motion of the contact members 18 creates a beating effect resulting in extinguishment of the fire. Motion is imparted to the contact members in a manner yet to be described.

The contact members 60 are resistant to heat and wear due to repetitive impact with hot ground, yet are supple and flexible to achieve a beating effect. A variety of materials may be used to compose the contact members 18. Some primary criteria of a suitable material are heat resistance, flexibility, moisture absorbency, and durability. The contact member composition must be heat resistant to withstand the extreme heat of fire. In addition, the material must be strong enough to endure abrasive forces, yet remain supple to permit the contact members 60 to collapse and smother the fire upon contact with the ground. Norfab, a brand name for a synthetic, woven material, is a preferred material for the contact members 60. Additionally, a fiber content of 80% cotton and 20% heat-resistant plastic has proven effective in extinguishing ground fires. However, any durable, fire-resistant material will be a sufficient alternative.

The physical properties, such as size, shape, density, and material content, of the contact members 18 depend on many factors. The size of the fire to be controlled and the type of vegetation through which the machine 10 travels will be considerations in selecting a suitable contact member. With respect to shape, a plurality of dense, pliable fibers, illustrated in FIGS. 1 and 5, will successfully extinguish ground fires. A rectangular, fin-shaped projection, supported on support member 68', as shown in FIG. 6, may be preferable when ground conditions yield tall brushy grass. A rectangular shape prevents entanglement of the contact members 60' with gangly brush and prevents undue wear of the contact members. However, any number of shapes will accommodate the beating motion of the contact members 18. It is simply a matter of selecting the shape best suited for the conditions.

Returning to FIG. 1, the length of the contact member 60 is a function of the size of the machine 10 and the swath covered by the machine as it travels over the terrain. Even the most durable materials deteriorate over time, causing the contact members 60 to shorten in length due to wear during use. Over a period of time, the contact members 60 may incur wear from abrasive and beating forces such that the contact members no longer reach the ground during operation of the machine 10. Consequently, it is desirable that the contact members 60 be of sufficient length to account for wear and deterioration. The extinguisher assembly 18 is adjustable in a manner yet to be described to lower the height of the contact members 60 so that worn members impact the land as the machine travels and extinguish fires. One preferred length for this purpose is three feet.

Figure 7:
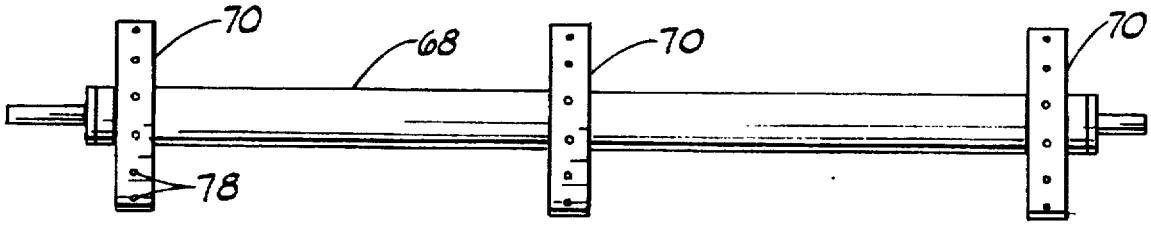
FIG. 7 is a perspective view of the support member which supports and transmits motion to the contact members of the machine of the present invention.

The contact members 60 are attached to the extinguisher assembly 18 via a support member 68, shown in FIG. 7. The support member 68 is movably attached to the extinguisher assembly 18 and imparts motion to the contact members 60. In the preferred embodiment, the support member 68 is adapted to rotate, causing the contact members 60 to rotate as well, imparting a centrifugal force thereto. The contact members 60 repetitively and forcefully impact the ground as the support member 68 rotates. Through rotation, the support member 68 transmits force through the contact members 60 to the ground, thereby extinguishing the fire.

The support member 68 may be adapted to move the contact members 60 in other ways which extinguish a fire. For instance, a vertical beating motion or a horizontal swishing motion may also effectively extinguish fires. It will be appreciated that the extinguisher assembly may be adapted to move in a number of ways to transmit force through the contact members 60 sufficient to extinguish fire.

Figure 5:
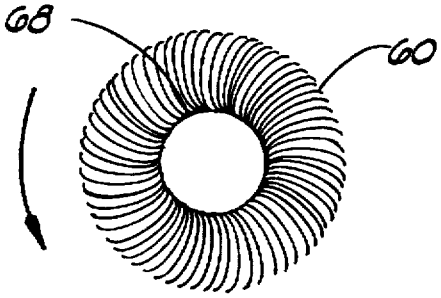
FIG. 5 is a cross sectional view of the contact members of the machine shown in FIG. 1, the view being taken along line 4—4 of FIG. 1.
Figure 6:
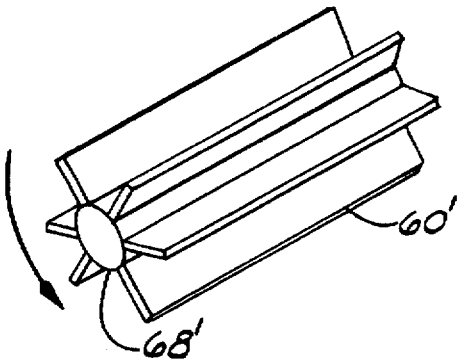
FIG. 6 is a perspective view of an alternative embodiment of the contact members wherein the contact members comprise fins.

With continuing reference to FIG. 7, the shape of the support member 68 preferably is an elongate cylinder having a round cross section, shown in FIG. 5. The length of the support member 68 extends across the width of the extinguisher assembly 18 to permit the contact members 60 to be arranged in a manner running the full length of the support member. This configuration maximizes the swath of land covered as the machine 10 is advanced and permits the support member 68 to carry more contact members 60, thus creating a denser plurality with a greater extinguishing power. Although a number of configurations may be used for the support member 68, a cylindrical configuration facilitates the rotating action of the support member and the continuous transmittal of force between the contact members 60 and the ground.

The support member 68 comprises means for attaching the contact members 60 to the machine 10. In a preferred embodiment, the support member 68 comprises three rings 70 supported radially and equidistantly along the length of the support member, as illustrated in FIG. 7. It will now be appreciated that the contact members 60 are secured to the rings 70 of the support member 68.

Figure 8:
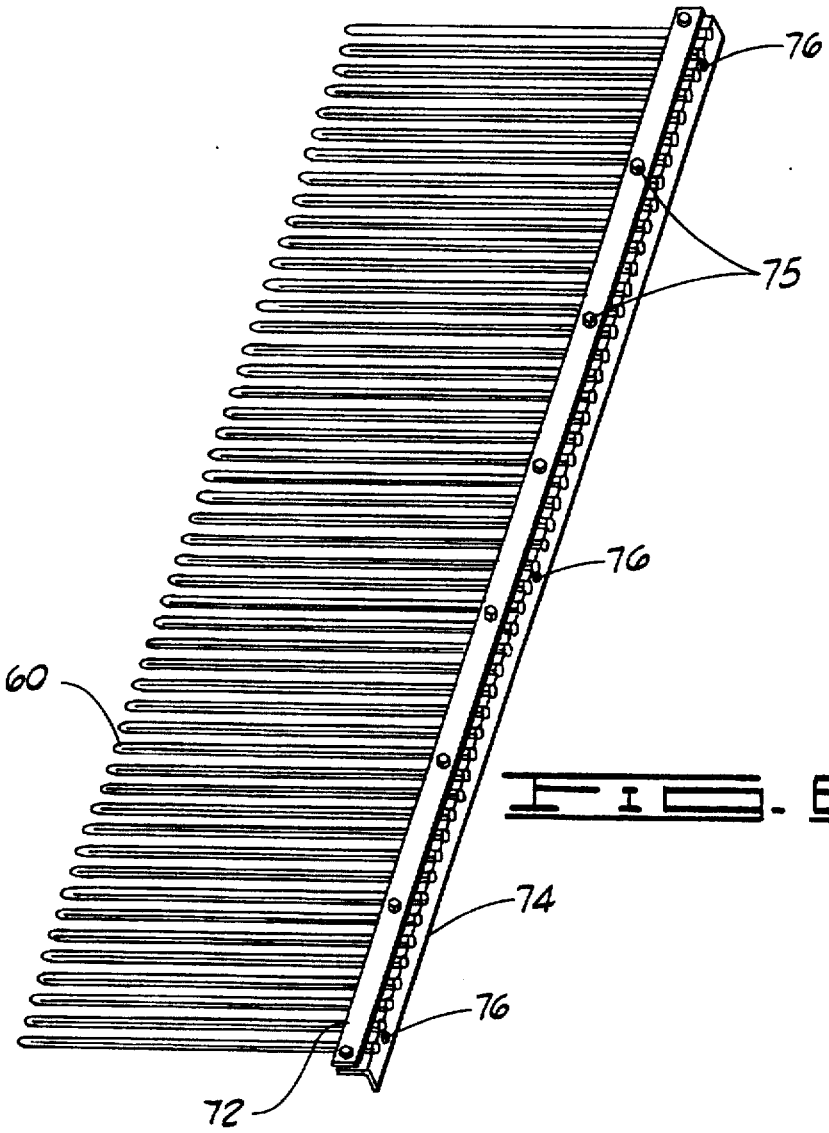
FIG. 8 is a perspective view of the attachment assembly which connects the contact members to the support member of the machine of the present invention.

Turning to FIG. 8, an attachment assembly adapted to connect the contact members 60 to the support member 68 is shown. The attachment assembly comprises two components 72 and 74 between which the contact members 60 are secured. The length of each of the components 72 and 74 approximates the length of the support member 68. Component 72 comprises a long, flat rectangular piece of metal or other strong material, and component 74 comprises an angular, or L-shaped piece of metal or other strong material, such as an angle iron. The contact members 60 are "sandwiched" between components 72 and 74 which are secured together by screws or bolts 75. The components 72 and 74 may be disassembled to remove or repair the contact members 60.

The angle portion of component 74 defines apertures 76 which are alignable with apertures 78 in the rings 70 of the support member 68. A screw or other connecting device is receivable through the aligned apertures 76 and 78 to secure the contact members 60 to the support member 68. This feature facilitates removal of the contact members 60 from the support member 68. Thus, the contact members may be repaired or replaced without replacing the extinguisher assembly 18, resulting in significant cost savings.

When imparting a rotating motion to the contact members 60, the support member 68 rotates in a forward, or counterclockwise, direction, as shown in FIG. 5. Forward rotation produces a hitting force against the ground. Reverse rotation imparts a sweeping motion to the contact members 60. A forward beating motion more effectively extinguishes fire than does a sweeping motion.

Returning to FIG. 1, it will now be appreciated that a support member drive system 80 drives the movement of the support member 68. The support member drive system 80 rotates the support member 68 which in turn transmits motion to the contact members 60. Any mechanism which imparts motion to the support member 68 thereby causing impact of the contact members 60 against the ground may be incorporated into the invention.

Figure 4:
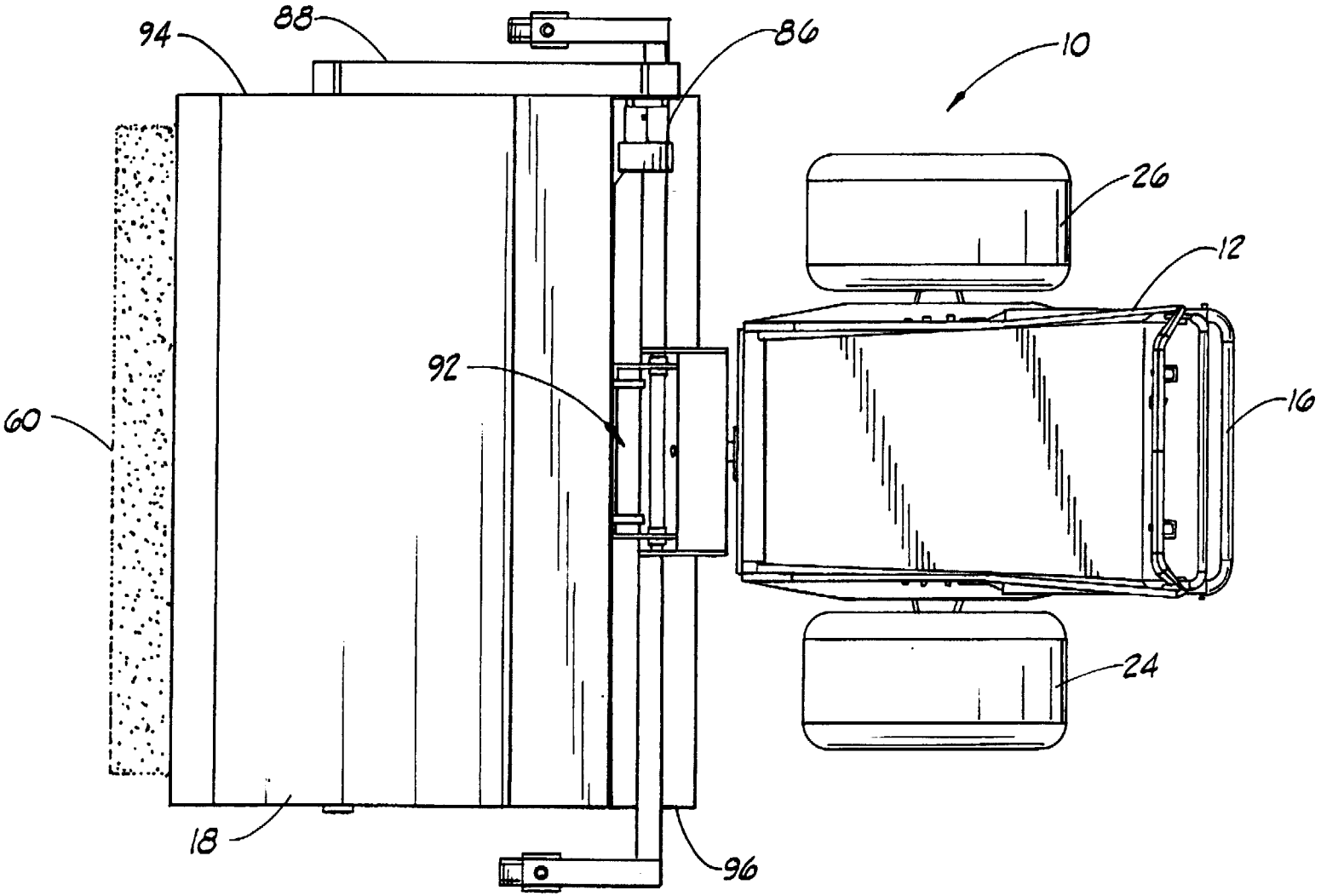
FIG. 4 is a top plan view of the fire extinguishing machine of FIG. 1.

In a preferred embodiment, shown in FIGS. 1 and 4, the support member drive system 80 comprises a motor 86 and a gear and chain assembly concealed by cover 88. The motor is powered by the hydraulic drive pump 36 and transmits torque to the gear and chain assembly. The gear and chain assembly rotates the support member 68, thereby causing the necessary movement of the contact members 60 against the ground.

Returning to FIG. 1, the fire extinguishing machine 10 may also comprise a moisture supply 90 adapted to feed moisture to the contact members 60. It will now be appreciated that the contact members 60 preferably are moisture absorbent to absorb water or fire fighting chemicals to aid in extinguishing the fire. Thus, the moisture supply 90 comprises a reservoir for storing moisture plus means for transmitting moisture to the contact members 60. The moisture supply 90 transmits moisture in the form of liquid, mist or foam, or solid particle chemical compositions, to or in the area of the contact members.

The moisture supply 90 may be positioned externally on the frame 12, as illustrated in FIG. 1. Alternatively, moisture may be fed internally under pressure to the contact members 60 through the support member 68. In a machine 10 lacking a moisture supply 90, contact members 60 may be wetted manually prior to use.

With continuing reference to FIG. 1, the machine 10 preferably comprises an adjustment assembly 92 adapted to adjust the height of the extinguisher assembly 18. In a preferred embodiment of the machine 10, the adjustment assembly 92 comprises a pair of screw jacks which are rotated to alter the height of the extinguisher assembly 18. It will now be appreciated that as the contact members 60 wear, the extinguisher assembly 18 may be lowered using the adjustment assembly 92 to enable the contact members to reach the ground, thereby extending the useful life of an extinguisher assembly 18.

Ideally, the machine 10 includes shields 94 and 96 to protect the operator from sparks and flying debris. A first shield 94 is positioned behind the contact members 60 and provides at least a partial housing for the contact members. The first shield 94 is comprised of the same strong, lightweight metal used to build the frame 12. A second shield 96 preferably is placed behind the extinguisher assembly 18. Shield 96 is made of a flexible, heat resistant material and functions like a flap dragging the ground behind the extinguisher assembly 18 to block the backward passage of debris toward the operator.

Figure 9:
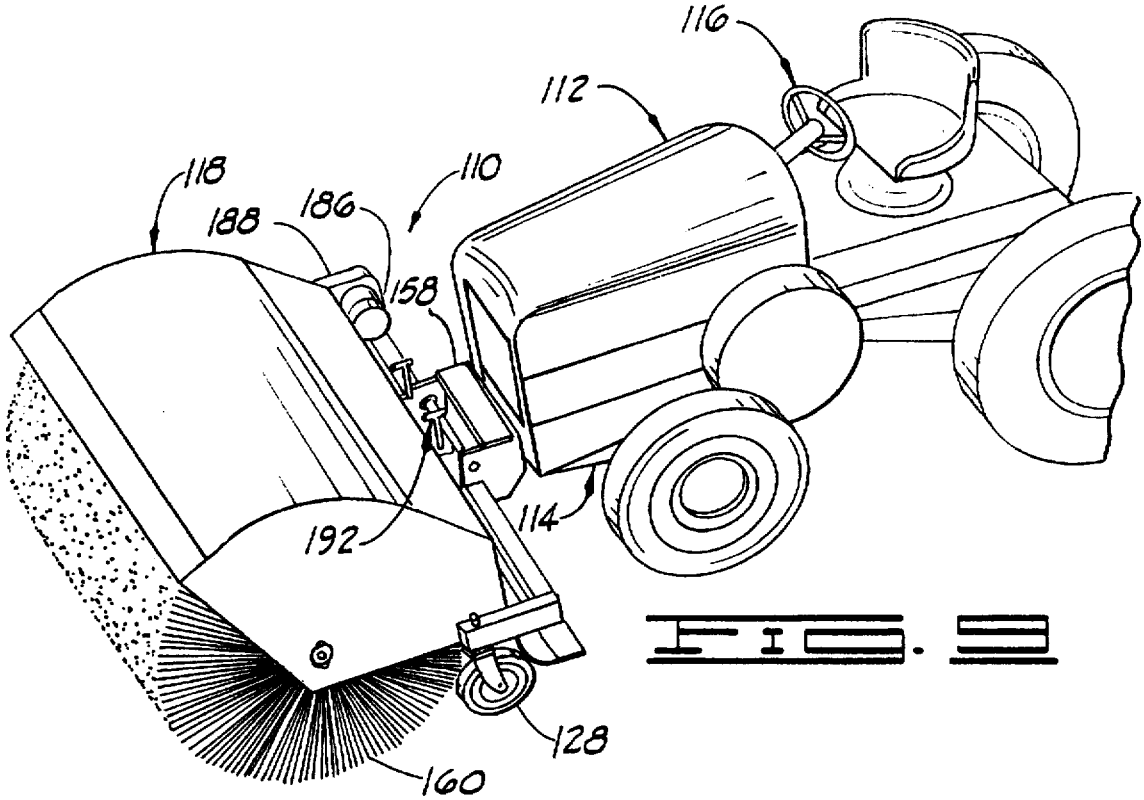
FIG. 9 is an alternative embodiment of the machine of the present invention, wherein the machine is a tractor-type vehicle.

FIG. 9 illustrates an alternative embodiment of the machine 110 of the present invention. In this embodiment, the frame 112 is a vehicle, much like a tractor-type or riding mower. Vehicular embodiments comprise the elements of the machine shown in FIG. 1. Conventional frame drive systems 114 and a steering assemblies 116 may be employed. Such system components generally comprise a steering wheel and post, manual or power steering gears, a pump and cylinder assembly, a clutch assembly, a transmission, and a differential. Vehicular models may further encompass other elements, such as an alignment system, air conditioning or heating systems, brake systems, and suspension systems. Machine 110 may further comprise an extinguisher assembly 118, wheel or caster 128, a mounting assembly 158, contact members 160, motor 186, cover 188, and adjustment assembly 192.

Figure 10:
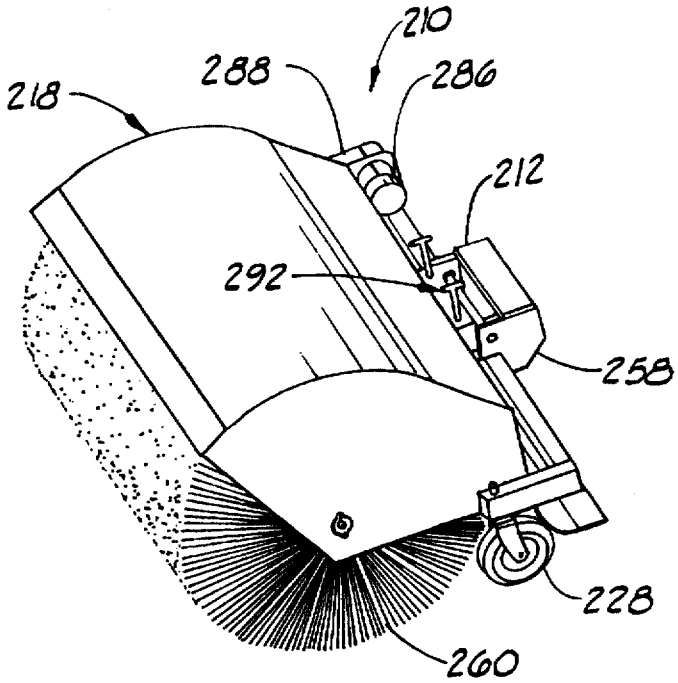
FIG. 10 is a perspective view of a third embodiment of the machine of the present invention, wherein the machine is attachable to a vehicle.

In a third embodiment, shown in FIG. 10, the frame 212 is constructed as an attachment to a vehicle for towing or pushing over the terrain. The machine 210 is connected to a hitch or other attaching means on a vehicle via mounting assembly 258. When attaching the machine 210 to a vehicle, the steering mechanism of the vehicle controls the direction of the machine. Alternatively, the mounting assembly may incorporate an extension, or arm attached to the vehicle and adapted to permit control of the machine from the remote location of the vehicle. Machine 210 may further comprise a frame 212, an extinguisher assembly 218, wheel or caster 228, contact members 260, motor 286, cover 288, and adjustment assembly 292.

Now it will be appreciated that the machine of the present invention provides an efficient mechanical means for extinguishing ground fires. The beating action of the contact members against the ground offers an efficient alternative to labor intensive methods and requires no more effort from the operator than walking behind or riding the machine while steering.

Changes may be made in the combination and arrangement of the various parts, elements, steps, and procedures described herein without departing from the spirit and scope of the invention as defined in the following claims.

I claim:

1. A machine for extinguishing a ground fire, the machine being adapted to travel over ground, the machine comprising:

an adjustable extinguisher assembly adapted to repetitively and forcefully contact the ground as the machine travels over the ground in an area of the fire; and an adjustment assembly being adapted to adjust a position of the extinguisher assembly;

wherein the repetitive, forceful contact of the extinguisher assembly with the ground causes the fire to be extinguished.

2. The machine for extinguishing the ground fire of claim 1 wherein the extinguisher assembly comprises:

a support member; and a plurality of fire-resistant contact members connectable to the support member;

wherein the support member is adapted to move the contact members to cause repetitive and forceful contact of the contact members with the ground as the machine travels over the ground.

3. The machine for extinguishing the ground fire of claim 2 wherein the support member comprises an elongate cylinder adapted to rotate and wherein the contact members are connectable to the support member about a periphery of the support member.

4. The machine for extinguishing the ground fire of claim 2 further comprising:

a connector assembly adapted to removably connect the contact members to the support member.

5. The machine for extinguishing the ground fire of claim 2 wherein the support member is moveable and wherein the extinguisher assembly further comprises a support member drive system adapted to drive movement of the support member.

6. The machine for extinguishing the ground fire of claim 2 further comprising a shield adapted to deflect debris, wherein the shield comprises at least a partial housing for the contact members.

7. The machine for extinguishing the ground fire of claim 2 further comprising a shield adapted to deflect debris, wherein the shield comprises a flexible flap adapted to drag the ground behind the extinguisher assembly.

8. The machine for extinguishing the ground fire of claim 2 wherein the contact members are composed of a fire-resistant material.

9. The machine for extinguishing the ground fire of claim 2 wherein the contact members are composed of a moisture-absorbent material.

10. The machine for extinguishing the ground fire of claim 9 further comprising a moisture supply adapted to supply moisture to the contact members.

11. The machine for extinguishing the ground fire of claim 1 further comprising a shield adapted to deflect debris.

12. The machine for extinguishing the ground fire of claim 1 further comprising a frame and a mounting assembly adapted to removably connect the extinguisher assembly to the frame.

13. The machine for extinguishing the ground fire of claim 12 wherein the frame is comprised of a metal alloy.

14. The machine for extinguishing the ground fire of claim 1 further comprising a frame and a frame drive system adapted to drive movement of the frame.

15. The machine for extinguishing the ground fire of claim 14 wherein the frame drive system comprises a gasoline powered engine and a hydraulic drive pump.

16. The machine for extinguishing the ground fire of claim 15 further comprising a steering assembly, the steering assembly comprising a plurality of handles and steering linkages connectable to the frame drive system.

17. The machine for extinguishing the ground fire of claim 1 further comprising a steering assembly adapted to control a direction of the machine.

18. A machine for extinguishing a ground fire, the machine being adapted to travel over ground, the machine comprising:

an extinguisher assembly adapted to repetitively and forcefully contact the ground in an area of the fire, the extinguisher assembly comprising:

an elongate, cylindrical support member defining a periphery and comprising a plurality of rings supported on the support member; and a plurality of fire-resistant contact members;

wherein the rings define a plurality of apertures adapted to removably receive the contact members;

wherein the support member is adapted to move the contact members to cause repetitive and forceful contact of the contact members with the ground as the machine travels over the ground in the area of the fire.

19. A machine for extinguishing a ground fire, the machine being adapted to travel over ground and comprising:

a movable frame adapted to travel over the ground;

a frame drive assembly adapted to drive movement of the frame;

a steering assembly adapted to steer the frame as it travels over the ground;

an extinguisher assembly adapted to repetitively and forcefully contact the ground in an area of the fire as the machine travels over the ground, wherein the repetitive, forceful contact of the extinguisher assembly with the ground causes the fire to be extinguished; and an adjustment assembly adapted to adjust a position of the extinguisher assembly.

20. The machine for extinguishing the ground fire of claim 19 wherein the extinguisher assembly comprises:

a support member; and a plurality of fire-resistant contact members connectable to the support member;

wherein the support member is adapted to move the contact members to cause repetitive and forceful contact of the contact members with the ground as the frame travels over the ground.

21. The machine for extinguishing the ground fire of claim 20 wherein the support member comprises an elongate cylinder adapted to rotate and wherein the contact members are connectable to the support member circumferentially thereabout.

22. The machine for extinguishing the ground fire of claim 20 further comprising:

a connector assembly adapted to removably connect the contact members to the support member.

23. The machine for extinguishing the ground fire of claim 20 wherein the support member is moveable and wherein the extinguisher assembly further comprises a support member drive system adapted to drive movement of the support member.

24. The machine for extinguishing the ground fire of claim 20 further comprising a shield adapted to deflect debris, wherein the shield comprises at least a partial housing for the contact members.

25. The machine for extinguishing the ground fire of claim 20 further comprising a shield adapted to deflect debris, wherein the shield comprises a flexible flap adapted to drag the ground behind the extinguisher assembly.

26. The machine for extinguishing the ground fire of claim 20 wherein the contact members are composed of a fire-resistant material.

27. The machine for extinguishing the ground fire of claim 20 wherein the contact members are composed of a moisture-absorbent material.

28. The machine for extinguishing the ground fire of claim 27 further comprising a moisture supply adapted to supply moisture to the contact members.

29. The machine for extinguishing the ground fire of claim 19 further comprising a shield adapted to deflect debris.

30. The machine for extinguishing the ground fire of claim 19 further comprising a mounting assembly adapted to removably connect the extinguisher assembly to the frame.

31. The machine for extinguishing the ground fire of claim 19 wherein the frame is comprised of a metal alloy.

32. The machine for extinguishing the ground fire of claim 19 wherein the frame drive assembly comprises a gasoline powered engine and a hydraulic drive pump.

33. The machine for extinguishing the ground fire of claim 19 wherein the steering assembly comprises a plurality of handles and steering linkages connectable to the frame drive assembly.

34. A machine for extinguishing a ground fire, the machine being adapted to travel over ground, the machine comprising:

a movable frame adapted to travel over the ground;

a frame drive assembly adapted to drive movement of the frame, a steering assembly adapted to steer the frame as it travels over the ground; and an extinguisher assembly adapted to repetitively and forcefully contact the ground in an area of the fire, the extinguisher assembly comprising:

an elongate, support member;

a plurality of rings supported on the support member; and a plurality of fire-resistant contact members, wherein the rings define a plurality of apertures adapted to removably receive the contact members;

wherein the support member is adapted to move the contact members to cause repetitive and forceful contact of the contact members with the ground as the machine travels over the ground in the area of the fire.

35. A method for extinguishing a ground fire utilizing a machine having contact members, the machine causing the contact members to repetitively and forcefully contact ground as the machine is moved over the ground, the method comprising the steps of moving the machine over the ground in an area of the fire while repetitively and forcefully contacting the ground with the contact members; and periodically adjusting a position of the contact members as the contact members wear to enable the contact members to repetitively and forcefully contact the ground.

* * * * *